US005913698A

United States Patent [19]

Keng

[11] Patent Number: 5,913,698

[45] Date of Patent: Jun. 22, 1999

[54] SHIELDED CONNECTOR

[75] Inventor: Lee-Yen (Leon) Keng, Taipei, Taiwan

[73] Assignee: Hon Hai Precision Ind. Co., Ltd., Taipei Hsien, Taiwan

[21] Appl. No.: 08/847,121

[22] Filed: May 1, 1997

[51] Int. Cl.[6] ..... H01R 13/648

[52] U.S. Cl. ..... 439/609; 439/939

[58] Field of Search ..... 439/607, 609, 439/939

[56] References Cited

U.S. PATENT DOCUMENTS

| | | | |
|---|---|---|---|
| 4,983,127 | 1/1991 | Kawai et al. | 439/609 |
| 5,178,562 | 1/1993 | Ermini | 439/939 |
| 5,288,248 | 2/1994 | Chen | 439/607 |
| 5,338,227 | 8/1994 | Nakamura | 439/607 |
| 5,622,523 | 4/1997 | Kan et al. | 439/607 |

*Primary Examiner*—Gary F. Paumen

[57] ABSTRACT

A connector includes an insulative housing (18), a plurality of contacts (23), a first shell (27), a second shell (38) and a grounding plate (44). The insulative housing (18) has a cubic body defining plural surfaces wherein a socket section (19) is disposed on one of such surfaces surrounded by an annular slot (20). A plurality of passageways (21) extend into the socket section (19). The first shell (27) and the second shell (38) commonly cover the most portions of the external surfaces of the body. The first shell (27) includes a pair of locking sections (35). A grounding plate (44) is adapted to be attached to the connector wherein the grounding plate (44) includes a pair of locking tags (49) for engagement with the corresponding locking sections (35) of the connector, respectively. The grounding plate (44) further includes an opening (47) in the front face (45) for allowing insertion of a plug into the socket (19). Plural of obliquely projecting grounding tangs (48) are disposed on the corners of the grounding plate (44) for engagement with the panel of the computer case.

6 Claims, 3 Drawing Sheets

SHIELDED CONNECTOR

BACKGROUND OF THE INVENTION

1. Field of The Invention

The invention relates to connectors, and particularly to the shielded connector having quickly attachable grounding means for engagement with the panel of the computer case.

2. The Related Art

U.S. Pat. No. 5,288,248 discloses a connector comprising an insulative housing shielded by two secured shells for Electro-Magnetic Interference consideration wherein a grounding plate is adapted to be hooked thereto for mechanical and electrical engagement with the backpanel of the computer case.

The disadvantage of the aforementioned prior art is that the combination of the grounding plate and the connector is implemented by hooks of the legs of the grounding plate embedded in the recesses of the housing, and thus fixation between the grounding and the connector may be jeopardized during the severe vibration situation.

Therefore, U.S. Pat. No. 5,622,523 discloses an improvement of the combination of the grounding plate and the connector wherein the grounding plate has to be attached to one of the shell first, and then assembled to the insulative housing of the connector. The disadvantages of the new design includes as follows:

(1) Assembling is complicate, thus increasing the number of the work station;

(2) Assembling is uneasy, thus taking the assembling time;

(3) Additional tools are required to implement the final assembly including the grounding plate and the connector;

(4) The configuration of the grounding plate is complex, thus using too much material to form the grounding plate; and (5) The obliquely protruding grounding plate tends to be damaged during delivery.

Therefore, an objection of the invention is to provide a connector which is adapted to cooperate with a grounding plate so that the grounding plate is easily attachably assembled to the connector to form the final assembly.

SUMMARY OF THE INVENTION

According to an aspect of the invention, a connector includes an insulative housing, a plurality of contacts, a first shell, a second shell and a grounding plate. The insulative housing has a cubic body defining plural surfaces wherein a socket section is disposed on one of such surfaces surrounded by an annular slot. A plurality of passageways extend into the socket section. The first shell and the second shell commonly cover the most portions of the external surfaces of the body. The first shell includes a pair of locking sections. A grounding plate is adapted to be attached to the connector wherein the grounding plate includes a pair of locking tags for engagement with the corresponding locking sections of the connector, respectively. The grounding plate further includes an opening in the front face for allowing insertion of a plug into the socket. Plural of obliquely projecting grounding tangs are disposed on the corners of the grounding plate for engagement with the panel of the computer case.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
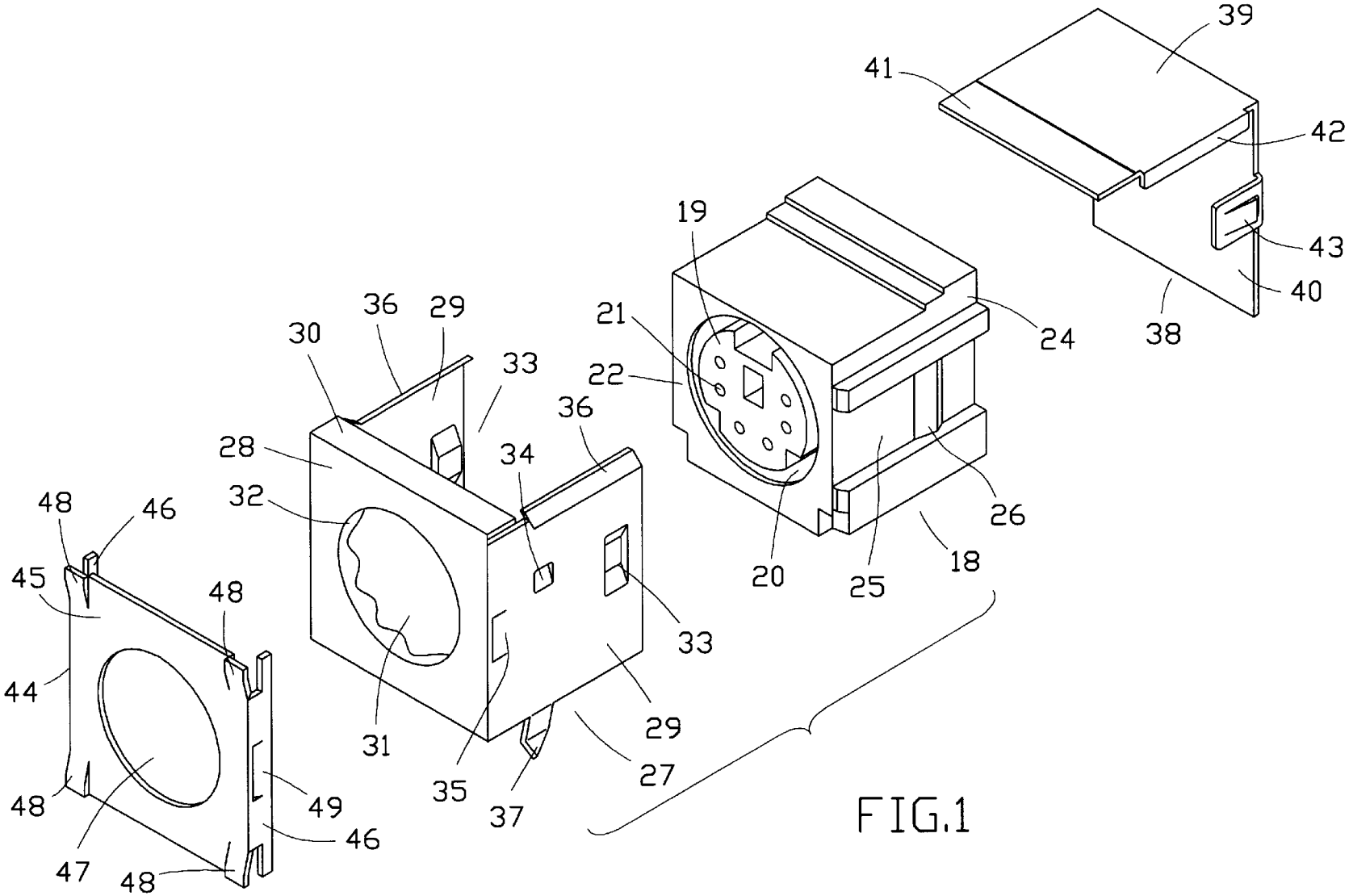
FIG. 1 is an exploded view of a presently preferred embodiment of a shielded connector assembly according to the invention.
Figure 2:
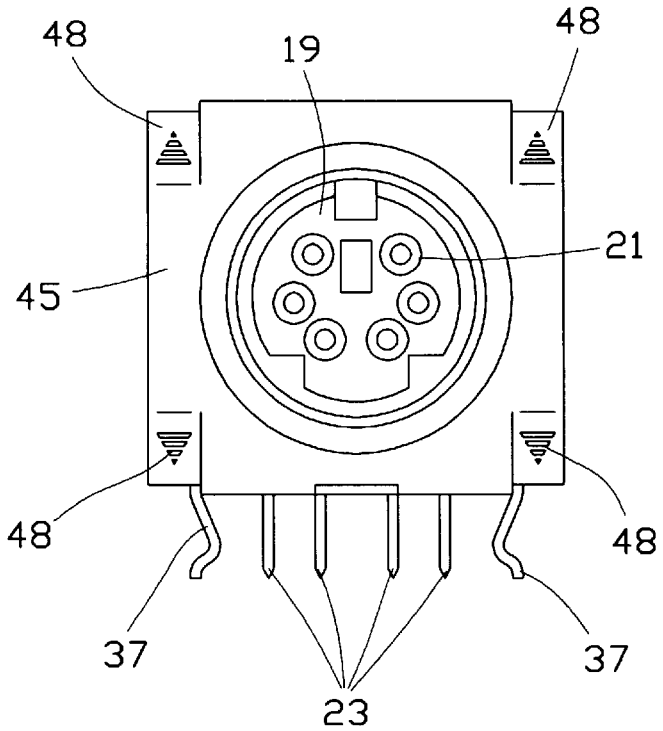
FIG. 2 is a front plan view of the assembled connector assembly of FIG. 1.
Figure 3:
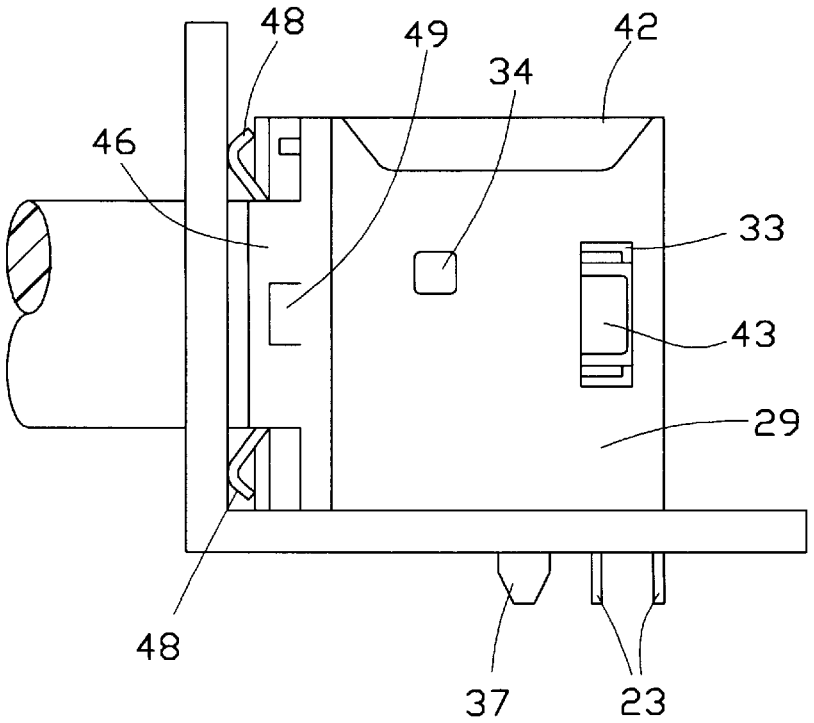
FIG. 3 is a side plan view of the assembled connector assembly of FIG. 1 installed within the computer wherein the housing of the connector is seated on the PC board and the grounding plate engages the backpanel of the computer case.
Figure 4:
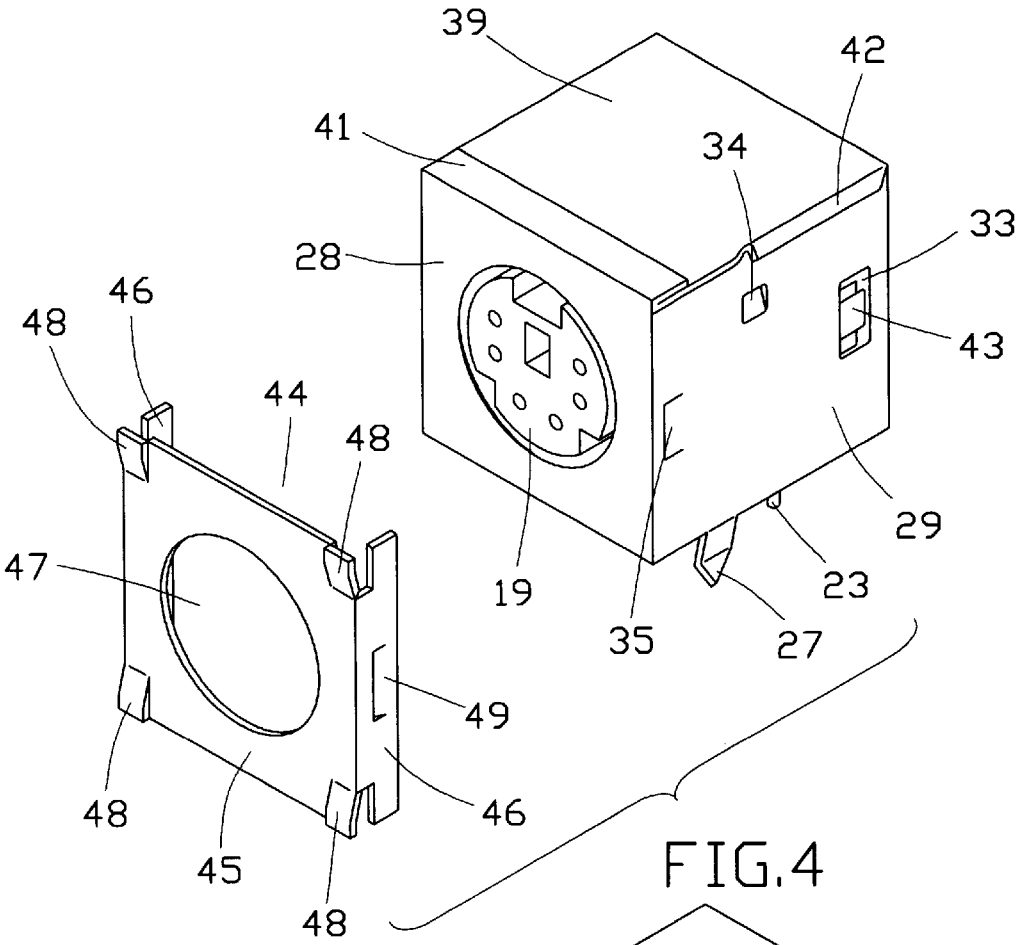
FIG. 4 is a perspective view of the assembled connector and a separate grounding plate of FIG. 1 which are ready for assembling.

It will be noted here that for a better understanding, most of like components are designated by like reference numerals throughout the various figures in the embodiments. Attention is directed to FIGS. 1–4 wherein a shielded connector includes an insulative housing 18 and a plurality of contacts 23 (FIGS. 2 and 3). The housing 18 is in a cubic form defining six external surfaces thereof wherein a front surface 22 defines a socket 19 surrounded by an annular slot 20. Moreover, a plurality of passageways 21 are disposed in the socket 19 wherein the passageways 21 first extend into the socket 19 from the corresponding surface 22 for a predetermined distance, and then downward extend parallel to such corresponding surface 22 and through the housing 18.

Further referring to FIGS. 2 and 3, the aforementioned contacts 23 are respectively received within the corresponding passageways 21. The end of each contact 23 projects out of a bottom plane for engagement with the PC board on which the connector is mounted. Each of two side surfaces 24 forms a guiding channel 25 with a locker 26 therein.

A first metal shell 27 comprises a front shielding face 28, two side shielding faces 29 and a top portion 30, wherein there is an opening 31 in the front shielding face 28 for exposing the socket 19 of the housing 18 to an exterior, and a serrated ring 32 is disposed along the opening 31 for connection with the shielding member of the complementary connector, so as to bring about the grounding effect. Corresponding to the locker 26 of the housing 18, a receiving section 33 is formed on the shielding face 29, so as to latchable engagement with the locker 26 after the first shell 27 is moved along the guiding channel 25 to be attached to the housing 18, thus resulting in the shell 27 is secured to the housing 18.

An inwardly pressing tang 34 is formed on each shielding face 29 so as to abut against the surface 24 in the channel 25 after the shell 27 begins to move along the channel 25. Moreover, each shielding face 29 includes a latching member 35 close to the front shielding face 28, a side flange 36 adjacent to the top portion 30 thereof, and a grounding leg 37 adjacent to the PC boar on which the connector is mounted.

A second metal shell 38 comprises a top shielding face 39 and a rear shielding 40 wherein the top shielding face 39 has a step 41 corresponding to the top portion 30 of the first shell 27, and a pair of flanges 42 on two sides corresponding to the side flanges 36 of the first shell 27. A pair of spring insertion tags 43 extend forward from two sides of the rear face 40 for respectively insertion within the receiving sections 33 of the first shell 27, thus completing assembling of the first shell 27 and the second shell 38. After assembled, the step 41 and the flanges 42 of the top shielding face 39 of the second shell 38 may tightly engage the top portion 30 and the side flanges 36 of the first shell 27, respectively, for eliminating the gap therebetween, thus accomplishing the whole shielded connector.

A grounding clip 44 comprising a front surface 45 and two side surfaces 46 wherein the front surface 45 includes an aperture 47 on the center for allowing passage of the complementary plug connector to mate the corresponding socket 19 of the housing 18. A plurality of resilient tangs 48 extend obliquely forward from the front surface 45 for mechanical and electrical engagement with the backpanel of the computer case and achievement of preferred grounding effect. A pair of locking tags 49 are provided on the side surfaces 46 for latchable engagement with the latching members 35 of the first shell 27, thus completing the whole shielded connector assembly with the associated grounding clip thereof.

Figure 5:
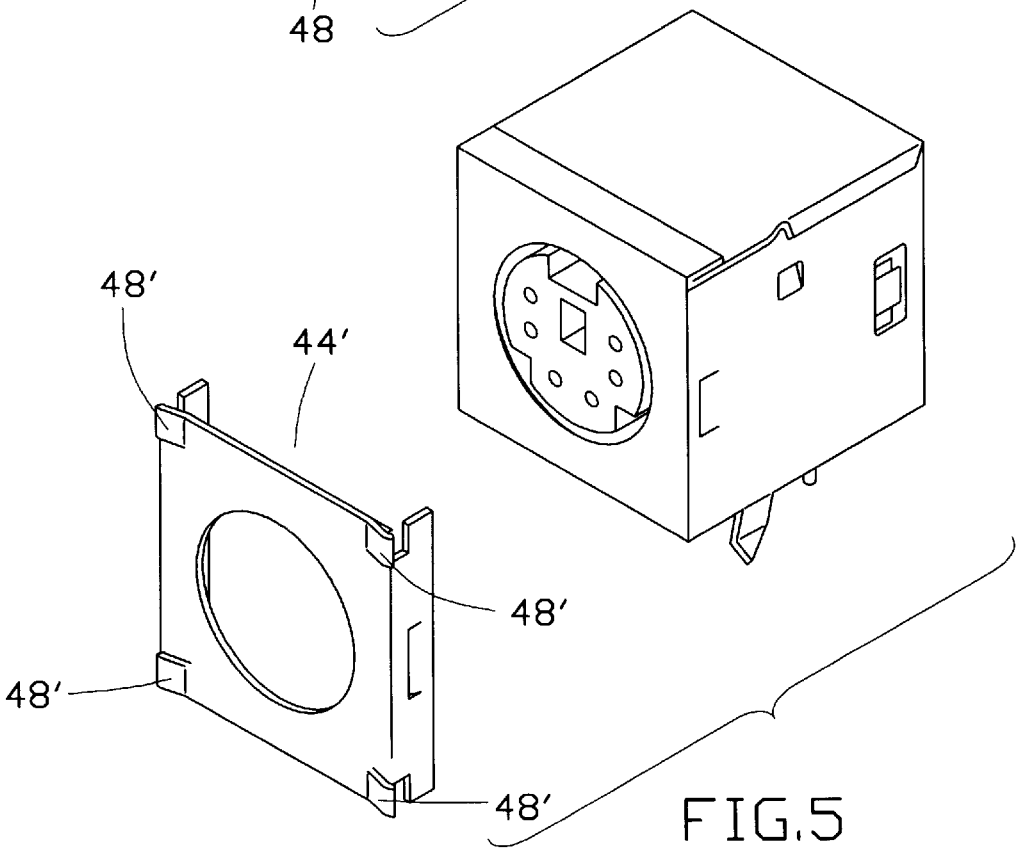
FIG. 5 is a perspective view of the assembled connector of FIG. 1 and another embodiment of the grounding plate which are ready for assembling.

FIG. 5 shows another embodiment of the invention wherein the resilient tangs 48' of the grounding clip 44' extend curvedly in a horizontal direction in comparison with that in the first embodiment.

It can be understood that the procedure of assembling the subject shielded connector is that the first shell 27 and second shell 38 are circumferentially attached to the housing 18, and successively the grounding clip 44 is attached to the first shell 27. Therefore, in comparison with the prior art as disclosed in the aforementioned U.S. Pat. No. 5,622,523, the invention may eliminate a few workstations, the assembling time and cost, and the material cost, and minimize the risk of damage of the grounding clips due to any improper packing or delivery. Additionally, because the grounding clip 44 in the invention is free to be optionally used with or without the shielded connector, it is more convenient for the user to decide if he needs to install or remove the corresponding grounding clip with regard to the shielded connector.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. A shielded connector assembly comprising:

an insulative housing with a plurality of contacts therein;

a first shell including at least one shielding face, said shell being adapted to be attached to the housing and defining a latching member; and a grounding clip including at least a front surface with at least one resilient tang extending forward therefrom, said grounding clip further including at least one locking tag for cooperation with the latching member of the first shell wherein said grounding clip can be later optionally attached to the housing and the first shell assembled.

2. The assembly as defined in claim 1, wherein the grounding clip further includes a pair of side surfaces and two said locking tags are respectively provide therewith for engagement with a pair of corresponding said latching members positioned on two side shielding faces of the first shell.

3. The assembly as defined in claim 2, wherein a second shell is adapted to be attached to the housing and latchably engaged with the first shell.

4. A method for assembling a shielded connector with an optionally equipped external grounding clip, the steps comprising:

providing an insulative housing with a plurality of contacts therein;

attaching a first shell, which includes a front shielding face and two side shielding faces, to the housing whereby the first shell is secured to the housing;

attaching a second shell, which includes a top shielding face and a rear shielding face, to the housing whereby the second shell is secured to the first shell;

providing a pair of latching members on two side shielding faces adjacent to the front shielding face on the first shell; and attaining a grounding clip, which includes a front surface and two side surfaces whereby the front surface of the grounding clip can be retainably attached to the front face of the first shell by a pair of locking tags positioned on the two side surfaces of the grounding clip that are latchably engaged with the corresponding latching members on the first shell.

5. A connector assembly comprising:

an insulative housing defining an annular slot and a socket therein;

a shell including a front face defining an opening generally in concentric alignment with said the annual slot; and a grounding clip includes a front surface defining an aperture substantially in same dimensional alignment with said opening; and side surfaces wherein the shell further includes two side faces, each of which has a latching member adjacent to the front face for cooperation with a corresponding locking tag positioned on either side surface of the grounding clip.

6. The assembly as defined in claim 5, wherein at least on resilient tang is provided on at least one corner of the front surface of the grounding clip.

* * * * *